US009429377B2

(12) United States Patent
Alkhalaileh et al.

(10) Patent No.: US 9,429,377 B2
(45) Date of Patent: Aug. 30, 2016

(54) FIREARM MAGAZINE RELEASE ASSIST DEVICE

(71) Applicants: Samer Alkhalaileh, Dublin, OH (US); John Richard Warnke, Westerville, OH (US)

(72) Inventors: Samer Alkhalaileh, Dublin, OH (US); John Richard Warnke, Westerville, OH (US)

( * ) Notice: Subject to any disclaimer, the term of this patent is extended or adjusted under 35 U.S.C. 154(b) by 0 days.

(21) Appl. No.: 14/625,101

(22) Filed: Feb. 18, 2015

(65) Prior Publication Data

US 2015/0316337 A1 Nov. 5, 2015

Related U.S. Application Data

(60) Provisional application No. 61/941,028, filed on Feb. 18, 2014.

(51) Int. Cl.

| | |
|---|---|
| ***F41A 9/61*** | (2006.01) |
| ***F41A 9/24*** | (2006.01) |
| ***F41A 17/38*** | (2006.01) |

(52) U.S. Cl.
CPC . *F41A 9/24* (2013.01); *F41A 17/38* (2013.01)

(58) Field of Classification Search
USPC ..... 42/6, 49.01, 50, 49.1
See application file for complete search history.

(56) References Cited

U.S. PATENT DOCUMENTS

| | | | | |
|---|---|---|---|---|
| 4,664,015 A * | 5/1987 | Kennedy | F41A 9/59 | 89/138 |
| 5,353,537 A * | 10/1994 | Mercenier | F41A 9/59 | 42/50 |
| 7,373,751 B1 * | 5/2008 | Schaffer | F41A 9/59 | 42/50 |

* cited by examiner

*Primary Examiner* — J. Woodrow Eldred
(74) *Attorney, Agent, or Firm* — Taylor Intellectual PLLC; James W. Taylor, II

(57) ABSTRACT

A firearm magazine assisted release device is provided. The release device comprises an external spring and method of securing that spring to the magazine. The spring is biased when the magazine is locked into a firearm, such that when the magazine release button is pressed stored potential energy is released as expansive kinetic energy, ejecting the magazine from the firearm.

20 Claims, 5 Drawing Sheets

FIREARM MAGAZINE RELEASE ASSIST DEVICE

This application claims priority under 35 U.S.C. 119(e) based upon Provisional Application Ser. No. 61/941,028 entitled FIREARM MAGAZINE RELEASE ASSIST DEVICE, filed Feb. 18, 2014, which is incorporated herein by reference in its entirety.

FIELD OF THE INVENTION

The disclosure as set forth herein is a firearm magazine release assist device that helps a firearm operator to remove a magazine from a firearm quickly and without any additional physical effort from the user.

BACKGROUND OF THE INVENTION

Many firearms utilize magazines to hold ammunition. Such firearms include most semi-automatic firearms, which fire a single round when the trigger is pulled but automatically cycle through all necessary steps to prepare another round to be fired, and fully-automatic firearms, which fire a plurality of rounds when the trigger is pulled or held. Examples of such firearms are carbines, many pistols, and semiautomatic shotguns. Once the firearm exhausts its rounds from the magazine, it is necessary to remove the spent magazine and replace it with a loaded one to continue discharging the firearm. Generally, removing a spent magazine requires that the firearm operator depresses a magazine release button. The magazine then falls out of the chamber by its own weight.

Firearm users, especially military and law enforcement, are sometimes faced with situations requiring them to quickly replace the firearm's magazine. Such situations may reasonably endanger the user's life. Therefore, it is important that magazine stripping is reliable and does not become a hindrance. Even a small delay in unloading of a spent or malfunctioning magazine and re-loading a full magazine could have grave results on the firearm operator.

Competition shooters, such as those involved in high speed shooting and magazine reloading, are often rate-limited by a spent magazine that does not release from the firearm. Their entire performance is bottlenecked by a mechanical process with little to do with the sport itself. In order to avoid such a situation, many such shooters release the magazine while it still contains some rounds because a partially full magazine is heavier than an empty magazine. As such, the magazine drops easier from the firearm than a lighter empty magazine. However, this comes at a cost: the user cannot fire the maximum number of rounds in each magazine.

Many firearm users have developed techniques and skills to allow them to quickly strip a spent magazine out of the firearm after the magazine release button is depressed. These techniques include a sweeping motion with the free hand. Such a motion applies a quick push on the magazine, allowing it to be quickly stripped out of the firearm. This sweeping hand motion is a skill that can only be acquired through dedicated training. Another technique utilizes a quick twist of the firearm to impart centrifugal force to the magazine that is enough to make it slide out of the magazine well by the magazine's own inertia. Yet another technique more commonly associated with pistols involves rapid shaking of the firearm, which helps overcome minor friction and may impart some centrifugal force to assist the magazine falling out of the well. Each technique uses valuable time that in which the user is not firing, possibly while taking fire.

Further, even if these skills are mastered, a user could potentially mistake the motions, resulting in a failure to strip the magazine from the firearm quickly. Therefore, these skills are not reliable and have inherent risk. Yet the skills might not be necessary if magazine stripping becomes automatic eliminating the need to develop special skills or techniques and ultimately decreasing the probability of failure.

Yet even further, firearm operators in dusty or sandy environments are faced with the challenge of dust or dirt getting into their firearms, especially onto the magazine or inside the magazine well. Presence of dust or dirt on the surface of the magazine increases the friction between the magazine body and the inside wall of the magazine well. This condition slows down the release of the magazine and the specialized skills discussed above may not be sufficient to release the magazine quickly. In extreme cases, the magazine may even hang inside the magazine well. Such a condition requires that the firearm operator uses his/her free hand to pull the magazine out of the firearm. Again, such a situation could have serious ramifications, including additional rounds being fired at the user before the user can neutralize his intended target, which increases the probability of being hit, endangering any missions and the user himself.

Continuous use of a firearm and its magazines will result in the increased temperature of both firearm and magazines, in some cases the magazines expand (swell) and become tightly wedged inside the magazine well. Ultimately this will increase the friction of the magazine against the firearm's magazine well, slowing or even stopping the magazine from falling out of the firearm without external influence.

In all of the above situations, removal of a spent magazine requires that the firearm operator pulls the magazine using the free hand which is a distraction and an extra effort that may literally endanger the firearm user's life. The net result is a decreased chance of a successful engagement.

Therefore, there is a need for a mechanism to assist in stripping a magazine from a firearm that is robust and adaptable to a plurality of firearms and magazines. Further, backward compatibility with firearms that have already been manufactured is highly desirable.

SUMMARY OF THE INVENTION

The present inventors have found that by biasing the magazine by the potential energy of a coiled spring or other potential energy storing device, the spring can be ejected under greater force than just the weight of the magazine.

While an internal spring can be utilized to eject magazines, this would require a special magazine that would interfere with the internal workings of the firearm, or it would require that the firearm is manufactured with this in mind. However, many fine weapons have already been created to date that would benefit from a kit that would assist in releasing the magazine from a firearm. Therefore, the present inventors have designed a kit that attaches externally to a magazine and mechanically biases the magazine relative to the firearm, storing potential energy, so that when the magazine release trigger is pressed, that stored potential energy is converted to kinetic energy, thereby ejecting the magazine from the firearm.

The invention is robust and can be applied to virtually any firearm that uses magazines. Several embodiments are presented below to address dynamic situations. For example, embodiment one discloses a magazine release assistance mechanism for a pistol that uses helical springs, which can have extreme expansive force, whereas embodiment two discloses the same for a carbine. Later embodiments use flat springs, which are more streamlined but may have less potential energy stored. It will be understood by the skilled artisan that virtually any magazine can be equipped with the inventive kit to assist releasing magazines.

In one aspect of the invention, the present invention comprises: a first static structure adapted to be externally secured to a firearm magazine; and a first spring attached the first static structure, wherein the first static structure has a mechanism to mechanically secure it to a firearm magazine, and wherein when the first static structure is mechanically secured to a magazine and when the magazine is locked into a firearm's magazine well, the first spring will compress storing potential energy that can be harnessed to push the magazine out of the firearm.

In another aspect of the invention, a method of ejecting a magazine from a firearm is provided comprising: securing a spring to the exterior of a magazine; locking the magazine into a firearm; and releasing the magazine from the firearm; wherein when the magazine is locked into the firearm, the spring stores potential energy by being compressed; and wherein when the magazine is released from the firearm at least a portion of that stored potential energy is converted into kinetic energy assisting the magazine to be ejected from the firearm.

In yet another aspect of the invention, a method of manufacturing a kit to attach a spring to the exterior of a firearm magazine to assist in releasing the magazine from the firearm is provided, comprising: providing a mounting structure that has a negative cutout of the cross-section of a firearm magazine; providing a spring assembly; and mating the mounting structure with the spring assembly, wherein the cutout is adapted to receive a magazine therein thereby mounting the spring assembly on the magazine such that when the magazine is locked into a firearm, tension is put on the spring such that when the magazine is ejected, the spring assists releasing the magazine.

DETAILED DESCRIPTION

Figure 1:
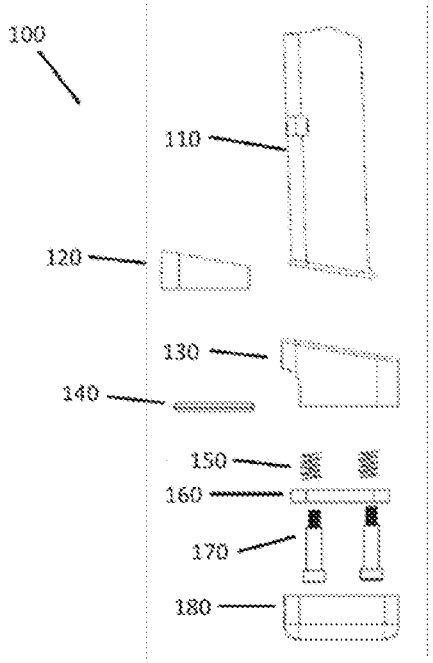
FIG. 1 shows an exploded view of a first embodiment of the invention.

For the purpose of promoting an understanding of the principles of the claimed technology and presenting its currently understood best mode of operation, reference will be now made to the embodiments illustrated in the drawings and specific language will be used to describe the same. It will nevertheless be understood that no limitation of the scope of the claimed technology is thereby intended, with such alterations and further modifications in the illustrated device and such further applications of the principles of the claimed technology as illustrated therein being contemplated as would typically occur to one skilled in the art to which the claimed technology relates.

The novel magazine release assist ("MRA") devices are exemplified for inter alia semi-automatic pistol ("SAP") and carbine magazines, but the skilled artisan could readily adapt the present invention for any firearm with a magazine in view of the following disclosure and embodiments.

In a broad aspect of the invention, a spring is connected to a firearm magazine externally. The spring is anchored to the magazine such that when the magazine is inserted into the firearm, the spring will compress against a part of the firearm or an attachment secured to the firearm, thereby storing potential energy. When the firearm's magazine release button is pressed, the spring will expand, converting potential energy into kinetic energy, giving the magazine momentum to eject from the firearm's magazine well.

While the embodiments below demonstrate custom aftermarket kits that are attached to the magazine, the present invention's scope cover embodiments where the spring is attached directly to the external parts of the magazine or is formed as part of the magazine itself.

While it most convenient for the spring to compress against the edge of the firearm's magazine well, it is to be understood that the skilled artisan could trivially design a spring assembly that compressed against another piece of the firearm.

The materials of the inventive MRA components are not particularly important. Any art standard material may be used. In particular, the inventive MRA may be made out of plastic, metal, composite, thermoset, rubber, latex, or any other material that can be molded, bent, stamped, laser-cut, otherwise cut, machined, or otherwise formed into the shape of the magazine release components. When selecting a material, several considerations are relevant, such as weight, toughness, impact resistance, failure rate, tendency to crack, ability to hold shape under load, spring characteristics, and coefficient of friction. A particularly preferred material is acetal homopolymer, such as commercially available Delrin™. Further material guidance may be found below for specific components.

It is within ordinary skill of the art to select the force at which the magazine will be pushed out of the firearm by selecting the spring constant values for the springs being used as part of the inventive MRA to store potential energy and ultimately eject the firearm's magazine. It is critical that the spring constant be high enough such that a particular spring can actually store enough energy to effectively assist in the release of the magazine. As would be understood by the skilled artisan, spring recoil energy and recoil distance depends on several factors. In particular, the spring's material thickness, spring geometry (primarily the diameter and height of the curved portion of the flat spring or the coil frequency of a spiral spring), heat treatment, annealing, the method used to manufacture the spring, and other spring material properties affect the spring constant. In general, flat springs are preferable, as they provide a simpler and cheaper solution that leads to a more compact and streamlined product. However, any spring is within the scope of the present invention. Generally, a metal or alloy will have the best physical properties for any spring assemblies. However, other materials, such as thermoset polymers, can be used for this application.

The spring may be part of an assembly that connects to a magazine's base plate or the magazine itself. Alternatively the spring may be connected to a different mechanism that in turn connects to the magazine's base plate or the magazine itself. Preferably, the spring is a flat spring assembly that is machined by either stamping and bending or laser-cutting and bending a piece of sheet metal or alloy that clips around the stock base plate of the magazine. However, in some embodiments a custom base plate may be manufactured to increase the lip of the base plate or accentuate other features which may benefit the spring assembly or attachment mechanism for the spring.

Figure 2:
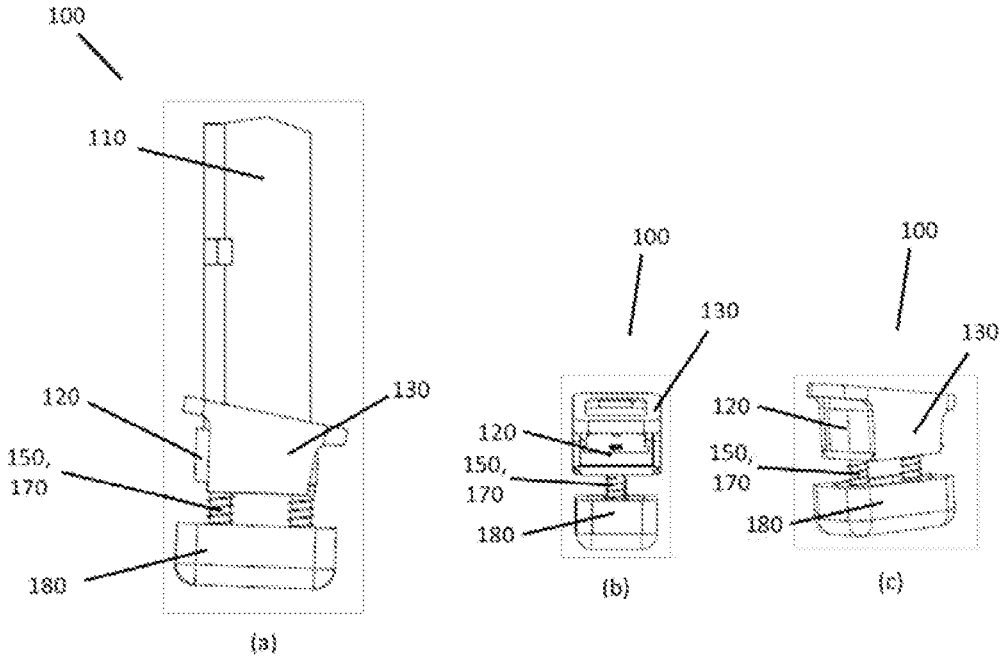
FIG. 2 shows a computer assisted drawing of a first embodiment of the invention installed (a) and uninstalled (b).
Figure 3:
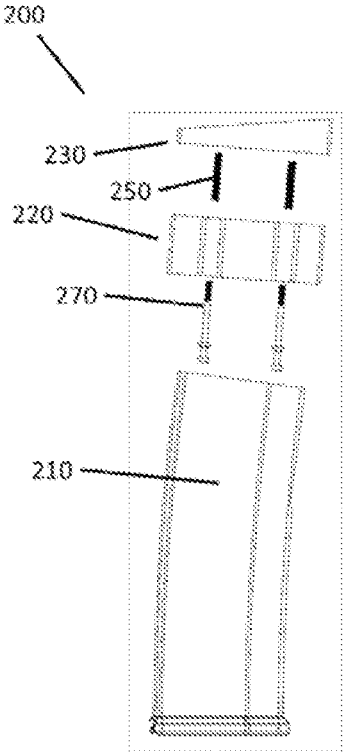
FIG. 3 shows an exploded view of a second embodiment of the invention.
Figure 4:
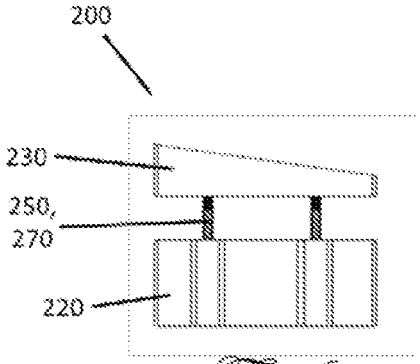
FIG. 4 shows a computer assisted drawing of a second embodiment of the invention, uninstalled.

Referring to FIGS. 1-2, a first embodiment of the invention is demonstrated. A SAP MRA kit 100 can be attached to a stock SAP magazine 110. Attachment of kit 100 entails replacement of the stock magazine base plate with the inventive SAP MRA base plate 120. All other components of the kits will attach to the SAP MRA base plate will be connected thereto.

Replacement base plate 120 serves the same functions as the stock base plate would have, except that it is adapted to connect to the rest of the kit.

Magazine base washer 130 is immediately above replacement base plate 120. Magazine base washer 130 acts to put force against the walls of the firearm's magazine well such that the magazine 110 is being pushed out of the firearm. The spring support plate 140 slides into or otherwise attaches to base washer 130 to create a connection for spiral springs 150. The spiral springs 150 are bounded by the spring support plate 140 on the magazine side of the kit and by bolt support plate 160 on the terminal side of the kit. Bolt support plate 160 supports the spring pressure created from spiral springs 150 and aligns the shoulder bolts 170 with holes (not shown) in spring support plate 140, optionally through the spiral springs as shown, and ultimately with the threaded holes (not shown) in the bottom of the replacement base plate 120. Cushion 180 acts as the terminal end of the kit.

This structure creates two independent static structures that move relative to each other as a function of spiral springs 150s' compressions down the axis created by the bolts. The magazine base plate 120, bolt base plate 160, bolts 170, and cushion 180 are all statically connected to the magazine once installed with no intended relative movement between them creating a first static structure. Opposing this first static structure, biased by spiral springs 150, is a second static structure that comprises magazine base washer 130 and spring support plate 140. The second static structure slides down the magazine 110 and shoulder bolts 170 as a function of spring compression. Therefore, when a magazine with the inventive kit 110 is installed, the bottom opening of the magazine well of the firearm (not shown) will collide with the second static structure and compress springs 150. That compression will build potential energy as the magazine is fully installed into the locked position. When the magazine release button is pressed, the expansive force of the springs will be released, applying expansive energy between the spring support plate 140 and the bolt base plate 160. As spring support plate 140 is part of the second static structure that is physically colliding with the magazine support well (part of the firearm) and as bolt base plate 160 is part of the first static structure that is physically attached to the magazine 110, as the spring expands, the magazine will be pushed out of the magazine well, and once the spring reaches maximum expansion and starts to recoil, the momentum of the magazine will "launch" the magazine out of the magazine well.

Cushion 180 is preferably made of a soft material, such as a thermoplastic or an elastomer. This allows a user comfort during magazine installation and also protects the firearm and kit in the event that the firearm is dropped.

Figure 5:
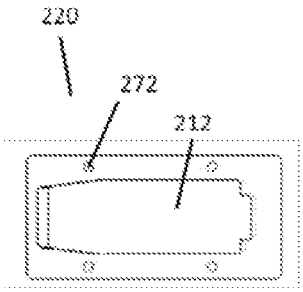
FIG. 5 shows a top view of a second embodiment of the invention's spring support block.
Figure 6:
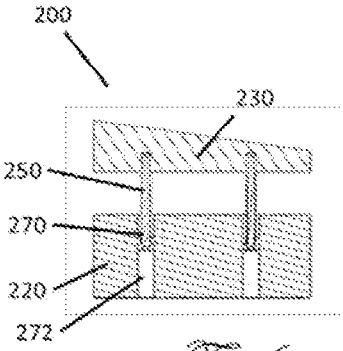
FIG. 6 shows a cross-section view of a second embodiment of the invention uninstalled.
Figure 9:
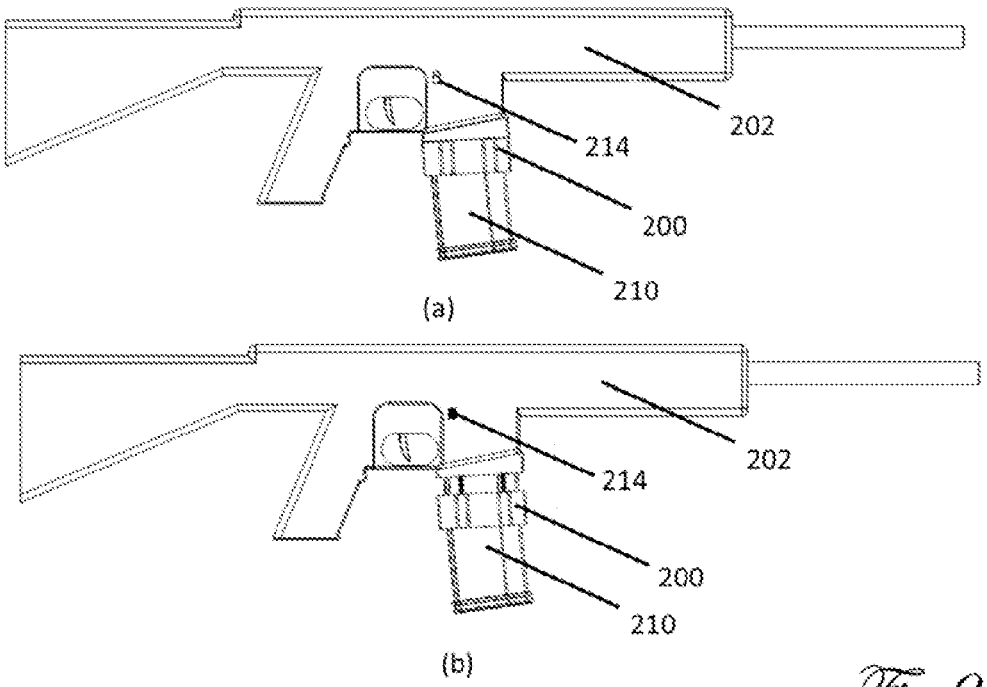
FIG. 9 illustrates a computer assisted drawing of a kit of the present invention installed onto a magazine that is (a) fully inserted and locked, and (b) partially inserted and not locked into a carbine.

Referring now to FIGS. 3-7, a second embodiment of the invention is shown. A carbine MRA kit 200 can be attached to the stock magazine 210 of a carbine. Spring support block 220 attaches to stock magazine 210 to create a first static structure comprising those components. Bolts 270 attach to push plate 230, which creates a second static structure comprising those components. As shown in FIG. 6, spring support block 220 comprises bolt wells 272, which act as channels down which bolts 270 can slide, guiding any relative motion between this embodiment's first and second static structures and giving the bolts somewhere to go when springs 250 are compressed. When a magazine 210 with kit 200 is installed, push plate 230 collides with the carbine's magazine well and as the magazine is fully installed, compresses springs 250 storing potential expansive energy. FIG. 9(*a*) shows the kit installed wherein the magazine is fully inserted and locked. Note that kit 200 is compressed, with virtually no gap because the spring is compressed and the two static structures are brought together. When the magazine is locked in place, that energy is stored. When a user presses magazine release button 214, springs 250 expand pushing the first and second static structures apart. FIG. 9(*b*) shows the kit 200 when the magazine is not fully inserted and the springs are expanded. As the first static structure comprises the spring support block 220, which is secured to the magazine, and because the second static structure comprises the push plate 230, which is pushing against the magazine well (part of carbine 202), the spring's expansive force pushes the magazine 210 out of its magazine. The net result is the magazine being ejected from carbine 202 under springs 250s' expansive forces.

Figure 7:
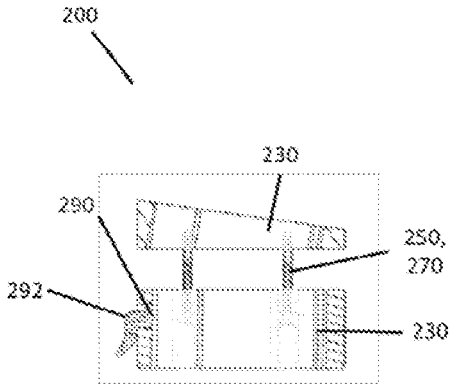
FIG. 7 shows a cross-section schematic of an optional securing mechanism to secure the kit of the present invention to a magazine well.
Figure 8:
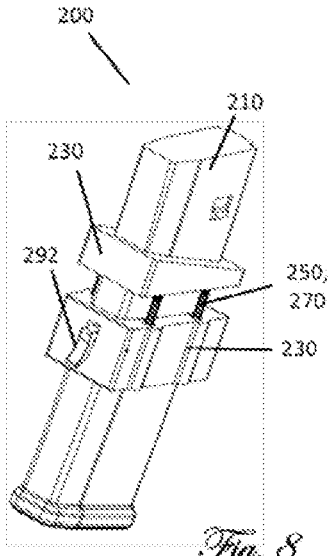
FIG. 8 shows a computer assisted drawing of an optional securing mechanism to secure the kit of the present invention to a magazine.

FIG. 5 shows a top view of spring support block 220. FIG. 6 shows a cross-section view of the carbine magazine release assist kit. Spring support block 220 has bolt wells 272 and magazine cutout 212. It is important that the magazine cutout accurately reflects the size and the shape of the magazine being used to create a mechanically secure link between the two components. Attachment of spring support block 220 to magazine 210 can be accomplished by art recognized structure. A preferred temporary attachment can be fabricated by utilizing set screws that penetrate through the walls of spring support block 220 and apply pressure to the magazine 210. Another preferred method is to make the spring support block 220 out of two sections that come together by bolts, and force a rubber material into a well that contracts when the two components of the spring support block 220 are brought together, thereby forcing the rubber into magazine cutout 212 when the bolts are secured. As such, friction will secure the spring support block 220 to magazine 210. Another attachment means is to use adhesive or glue on the interior of magazine cutout 212 to bond the spring support block 220 to magazine 210. Yet another preferred attachment is to utilize a toggle lock which applies pressure onto the magazine body. Referring to FIGS. 7-8, a toggle lock to secure a MRA kit to a magazine is shown. Attachment between the spring support block 220 and magazine 210 is accomplished by placing rubber shims 290. Shim release button 292 can be pressed to remove friction from the magazine and slide the spring support plate down the magazine 210. While rubber is exemplified, several different materials may be used as shim stock, including inter alia thermoplastics, thermosets, latexes, or metal. Importantly, the only requirement on shim material is that it has a reasonable coefficient of friction as would be recognized by one of ordinary skill in the art such that it will properly secure the spring support block 220 relative to magazine 210.

Figures 10, 11:
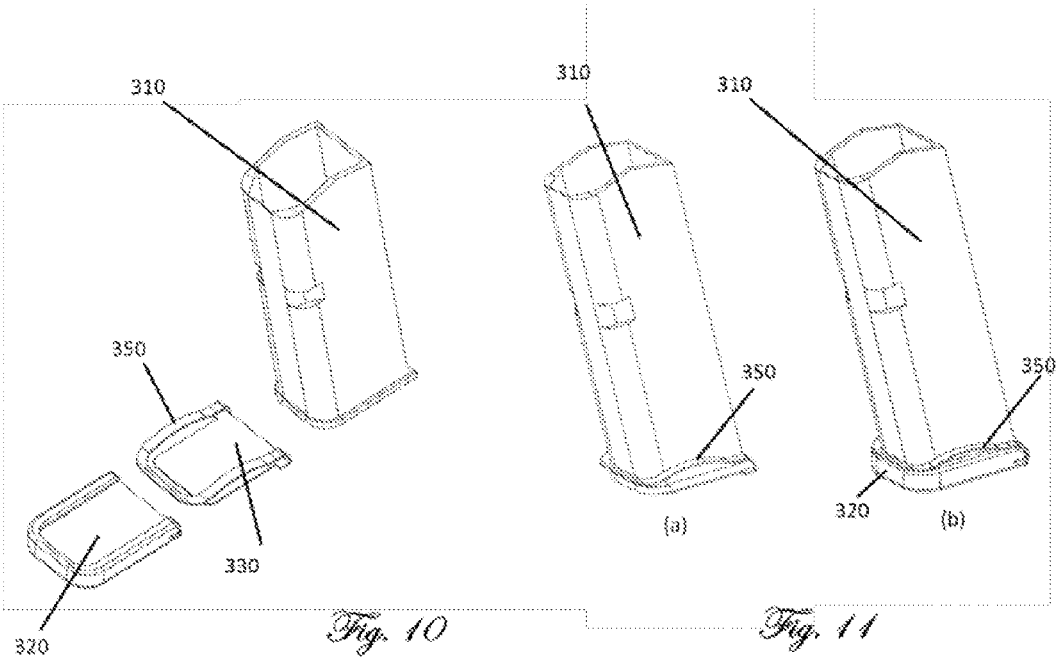
FIG. 10 shows a computer assisted drawing of components of a third embodiment of the invention.
FIG. 11 shows a computer assisted drawing of a third embodiment of the invention (a) without the base plate and (b) fully installed.

Referring now to FIGS. 10-11, another embodiment of the invention is shown. Flat spring assembly 330 is designed and configured such that it can be pried open mechanically deforming it, and the magazine 310 (without a base plate attached) can be inserted into the deformed clip spring assembly 330. When the deforming forces are eliminated, spring assembly 330 recoils to its initial shape, which is contoured to lock the spring assembly 330 to the bottom of magazine 310, such as shown in FIG. 11(*a*). The magazine base plate 320 can then be attached back onto magazine 310 and spring assembly 330, thereby further securing the spring assembly 330 to magazine.

Generally in this embodiment, stock base plates are insufficient and custom base plates must be used as base plate 320. However, it is possible that a stock base plate could be made to the appropriate specifications to work as the embodied base plate. In this manner, when the magazine is fully installed into a firearm, spring 350 is biased to the magazine well directly and stores potential energy to eject magazine 310 when the magazine release button is pressed.

Figures 12, 13, 14:
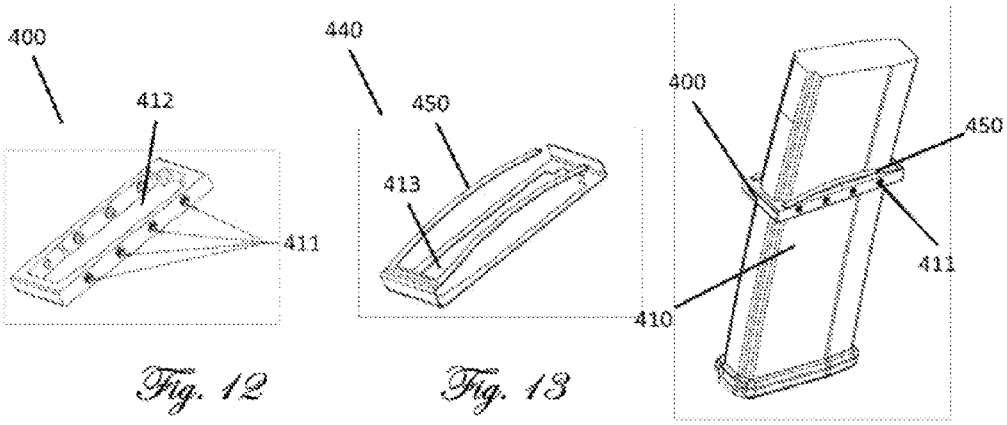
FIG. 12 shows a computer assisted drawing of the carbine magazine anchor for a fourth embodiment of the invention.
FIG. 13 shows a computer assisted drawing of the flat spring for a fourth embodiment of the invention.
FIG. 14 shows a computer assisted drawing of the assembled magazine release assist according to a fourth embodiment of the invention.

Referring now to FIGS. 12-14, a fourth embodiment of the invention is shown. Circumferential support ring 400 is provided and adapted to physically surround a carbine magazine 410, which projects from the carbine when locked and fully installed. The support ring 400 is inserted into spring means 440, in which magazine 410 is slide into magazine cutouts 412 and 413. The support ring 400 is anchored to magazine 410 using bolts 411 at a distance down the magazine such that when flat spring 450 is installed thereon, flat spring 450 will bias against the magazine well (not shown) to store potential energy as with previous embodiments.

Figure 15:
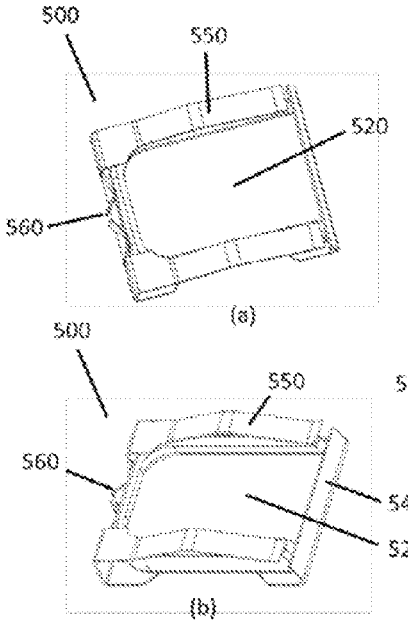
FIG. 15 illustrates two perspective views of a fifth embodiment of the invention.
Figure 16:
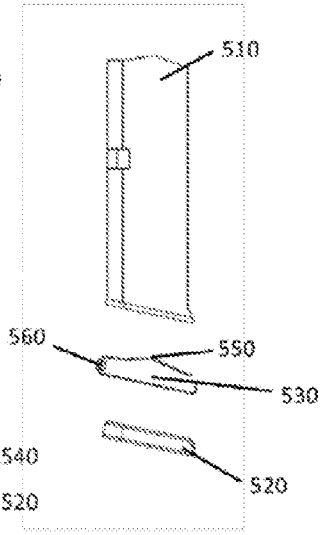
FIG. 16 illustrates an exploded view of an installed kit according to a fifth embodiment of the invention.
Figure 17:
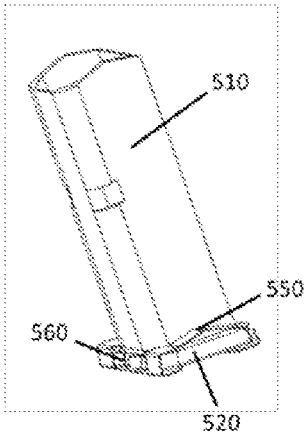
FIG. 17 illustrates a perspective view of an installed kit according to a fifth embodiment of the invention.

Turning now to FIGS. 15-17, a fifth embodiment of the invention is shown. This embodiment is useful for SAPs. Kit 500 comprises spring assembly 530 and attachment base 520. Preferably attachment base 520 is the stock base plate for the magazine. Alternatively, attachment base 520 may be a custom base plate. Attachment base 520 is installed onto magazine 510. Attachment base 520 acts as a mating surface for spring assembly 530 as is shown in FIGS. 15(*a*) and 15(*b*). Spring assembly 530 comprises bent lip 540, angled flat springs 550, and tension springs 560. Spring assembly 530 is mechanically pried open by lifting angled flat springs 550, and attachment base 520, which is pre-installed onto magazine 510, is inserted therein. Tension springs 560 will be compressed as the attachment base 520 biases them. Mechanical prying forces are then removed so angled flat springs 550 of spring assembly 530 will recoil to their initial shape, thereby surrounding the attachment base 520. Tension springs 560 will push the attachment base 520 onto the opposing surface, which is the inner surface of bent lip 540, thereby preventing wiggling and mechanically securing the spring assembly 530 to the attachment base 550. Because attachment base 520 is mechanically secured to magazine 510, spring assembly 530 is transitively secured to magazine 510 when it is mated with and secured to the attachment base 520, as is shown in FIGS. 15(*b*) and 17.

Spring 550 is a bent flat spring that is the active mechanism to store potential expansion energy. When magazine 510 with kit 500 is installed into a SAP, spring 550 collides with the SAP's magazine well and compresses, storing potential energy. As with embodiments before, using the firearm's magazine release button will release that potential energy as expansive energy, effectively launching magazine 510 out of the firearm.

The term "static" has been used with regard to a plurality of components connected each other in the above description. It is to be understood that by "static," the present inventors mean a single or plurality of components that have no intended movement between them, acting as if they were a complex but non-moving monolithic piece. Naturally, two static components may move relative to each other, but no subcomponent of a static structure moves relative to another subcomponent of that static structure.

It will also be recognized by those skilled in the art that, while the invention has been described above in terms of preferred embodiments, it is not limited thereto. Various features and aspects of the above described invention may be used individually or jointly. Further, although the invention has been described in the context of its implementation in a particular environment, and for particular applications (e.g. a kit for a firearm magazine), those skilled in the art will recognize that its usefulness is not limited thereto and that the present invention can be beneficially utilized in any number of environments and implementations where it is desirable to integrated with a stock magazine, used outside of SAP and carbines, and similar. Accordingly, the claims set forth below should be construed in view of the full breadth and spirit of the invention as disclosed herein.

The invention claimed is:

1. A release-assisting device for a firearm magazine comprising:

a first static feature to be secured to the external periphery of a firearm magazine or integrated as an external part of a firearm magazine under the proviso that when the first static feature is adapted to be secured to the external periphery of a firearm magazine, the first static feature comprises a mechanism to mechanically secure it to a firearm magazine; and a first spring attached to the first static feature;

wherein when the first static feature is mechanically secured to a magazine and when the magazine is locked into a firearm's magazine well, the first spring will compress storing potential energy that can be harnessed to push the magazine out of the firearm.

2. The device of claim 1, further comprising: a firearm magazine, wherein the magazine is mechanically secured to the first static feature.

3. The device of claim 2, further comprising: a firearm, wherein the magazine is installed into the firearm and the first spring is compressed by a physical structure of the firearm.

4. The device of claim 3, wherein the first static feature is adapted to be integrated as an external part of the firearm magazine.

5. The device of claim 1, wherein the first spring is a flat spring.

6. The device of claim 1, wherein the first static feature comprises at least two parts: a first part and a second part.

7. The device of claim 6, wherein the first static feature adapted to be secured to the external periphery of a firearm magazine, and wherein the first part is bolted, screwed, bonded, glued, or attached to a firearm magazine.

8. The device of claim 7, wherein the second part is mechanically secured to the first part, and wherein the second part is not directly bolted, screwed, bonded, glued, or attached to the magazine under the proviso that the second part may circumferentially surround the magazine and physically touch it but for the purposes of this claim and dependent claims, such a circumferential surrounding or any physical interfaces as a result of that circumferential surrounding shall not be interpreted as bolting., screwing, bonding, gluing, or attaching the second part to the magazine.

9. The device of claim 6, wherein:

the second part is made of laser-cut sheet metal, said sheet metal is bent to form a second spring, said second spring is a flat spring, and said second spring puts tension on the first part and a firearm magazine to mechanically secure the first part to the firearm magazine.

10. The device of claim 1, comprising a second static feature, wherein the second static feature is attached to the opposite end of the first spring relative to the first static feature.

11. The device of claim 10, further comprising:

aligning bolts, wherein the first static feature and the second static feature each independently have at least one of: bolt holes, bolt tracks through which bobs can dynamically slide but not escape due to lips of the tracks catching the bolts flange, or female bolt threads; and wherein the aligning bolts are installed into the first and second static feature's at least one of bolt holes, bolt tracks, and bolt threads such that the first and static structures can still move relative to one another but are aligned relative to each other, only moving down the axis that the bolts create.

12. The device of claim 1 wherein the first spring is integrated with the first static feature, and each are machined from a single piece of material.

13. The device of claim 12, wherein the first static feature is manufactured from laser-cut and bent sheet metal that forms the first spring.

14. The device of claim 13, wherein the first spring is a flat spring.

15. A method of manufacturing a kit to attach a spring to the exterior of a firearm magazine to assist in releasing the magazine from the firearm, comprising:

providing a mounting structure that has a negative cutout of the cross-section of a firearm magazine;

providing a spring assembly; and mating the mounting structure with the spring assembly, wherein the cutout is adapted to receive a magazine therein thereby mounting the spring assembly on the magazine such that when the magazine is locked into a firearm, tension is put on the spring such that when the magazine is ejected, the spring assists releasing the magazine.

16. The method of claim 15, where in the mounting structure and the spring assembly are a single assembly.

17. The method of claim 16, wherein the single assembly is laser cut and bent or stamped and bent from a sheet of metal or metal alloy to form the cutout and at least one spring.

18. The method of claim 17, wherein the spring is a flat spring.

19. A method of ejecting a magazine from a firearm comprising:

securing a spring to the exterior of a magazine:

locking the magazine into a firearm; and releasing the magazine from the firearm;

wherein when the magazine is locked into the firearm, the spring stares potential energy by being compressed; and wherein when the magazine is released from the firearm at least a portion of that stored potential energy is converted into kinetic energy assisting the magazine to be ejected from the firearm.

20. The method of claim 19, wherein the spring is a flat spring.

* * * * *